US005746607A

United States Patent [19]

Bricaud et al.

[11] Patent Number: 5,746,607

[45] Date of Patent: May 5, 1998

[54] SMART CARD ELECTRICAL CONNECTOR

[75] Inventors: Herve Guy Bricaud, Dole; Fabrice Valcher, Damparis, both of France

[73] Assignee: ITT Composants et Instruments, France

[21] Appl. No.: 688,180

[22] Filed: Jul. 26, 1996

[30] Foreign Application Priority Data

Jul. 28, 1995 [FR] France ..... 95 09205

[51] Int. Cl.[6] ..... H01R 9/09

[52] U.S. Cl. ..... 439/66; 439/630

[58] Field of Search ..... 439/66, 74, 660, 439/630

[56] References Cited

U.S. PATENT DOCUMENTS

| | | | |
|---|---|---|---|
| 4,623,207 | 11/1986 | Sasaki et al. | 439/631 |
| 5,231,274 | 7/1993 | Reynier et al. | 439/636 |
| 5,241,453 | 8/1993 | Bright et al. | 439/607 |

FOREIGN PATENT DOCUMENTS

| | | | |
|---|---|---|---|
| 0 476 892 A1 | 6/1991 | European Pat. Off. . | |
| 2606695 | 2/1976 | Germany . | |
| 9400349 U | 6/1994 | Germany . | |
| 9518421 | 7/1995 | WIPO | G06K 7/06 |

OTHER PUBLICATIONS

IBM Technical Disclosure Bulletin; vol. 6, No. 10, Mar. 1964; Plated Through Hole Contact; H.C. Schick.

*Primary Examiner*—Neil Abrams
*Assistant Examiner*—T. C. Patel
*Attorney, Agent, or Firm*—Freilich Hornbaker Rosen

[57] ABSTRACT

An electrical connector (16) is provided for mounting on a circuit board (10) to connect contact pads (100) of the card to conductive traces (102) on the circuit board. The connector includes a body (20) that carries sheet metal strip contacts (26, 26') that project above an upper face (36) of the body. The contact tails (44) are resiliently deflectable, and each has a trace-engaging part (68) that projects beneath the lower bearing face (66) of the body and which can be deflected up into a cavity at the bottom of the body when engaging the circuit board.

4 Claims, 4 Drawing Sheets

SMART CARD ELECTRICAL CONNECTOR

BACKGROUND OF THE INVENTION

The present invention relates to an electrical connector for the connection of contact-type integrated circuit cards, or smart cards, to a device such as a read/write device, where the device includes at least one circuit board whose upper face has conductive traces that engage the connector contacts.

Electrical connectors are used to connect to contact pads of smart cards, also known as contact-type integrated circuit cards, electronic memory cards, or chip cards. The connector includes an insulative body that carries electrical contacts that project above an upper face of the body to engage the contact pads on the card. Each contact is in the form of a bent strip having a fixing portion fixed to the body, a card-engaging part that projects above the upper face of the body, and a contact tail which connects to a circuit board trace.

There have been proposals to mount the connector on the circuit board by fixing it to the board in the same manner as any other electronic component, as by soldering. International application PCT/FR95/00959 shows an arrangement that includes a casing fixed on a circuit board face, which includes a housing that receives the body of an electrical connector. That document proposes "pinching" of the contact tails between traces on the face of the circuit board and the opposing face of an upper board of the casing. Such design allows a significant reduction in the total height of the connector and casing assembly. However, the assembly is bulky because the connector, together with the means of fixing it to the board, occupies a significant surface area of the board. Moreover there may not be reliable low resistance engagement of the contacts and the circuit board traces. A connector of relatively simple construction, low height, and small length and width, which could be readily mounted on a circuit board without requiring soldering operations, would be of value.

SUMMARY OF THE INVENTION

In accordance with one embodiment of the present invention, a connector is provided that can be easily installed on a circuit board, with tails of the connector contacts reliably connected to circuit board traces, in a relatively small package. The contact tails initially project below the bottom surface of the connector body. When the body is lowered onto the circuit board, the contact tails are resiliently deflected upwardly and bear against the resilient board traces.

The contact tails lie in a recess or cavity in the bottom of the connector body. The contacts are formed of strips of metal, usually by punching out of sheet metal, and the contact tails have curved parts with convex lower faces that engage the circuit board traces.

Each contact has a fixing portion that is substantially fixed to the connector body. Each contact tail includes an elbow forming a bend, the elbow merging with a substantially straight connection limb extending at an acute angle of less than 60° to the horizontal, the connection limb ending in the trace-engaging part of the tail. Pivoting of the tail occurs largely at the elbow. The tail has a free end that bears against a stop surface of the body, so as to determine an initial position of the trace-engaging part so it lies a predetermined distance below the lower face of the connector body.

The connector has forward and rearward longitudinally-spaced sets of contacts. One set of contacts has its trace-engaging parts lying substantially directly below the card-engaging parts. The other set of contacts has its trace-engaging parts longitudinally offset from a position below its card-engaging parts. As a result, the trace-engaging parts lie close together to engage traces that occupy only a small region of the circuit board.

The connector is associated with a protective casing, especially an electrically conductive casing. The casing has an open upper face so the card-engaging contact parts can project above it. The casing has an open lower face for passage of the trace-engaging parts of the contact.

The novel features of the invention are set forth with particularity in the appended claims. The invention will be best understood from the following description when read in conjunction with the accompanying drawings.

DESCRIPTION OF THE PREFERRED EMBODIMENT

Figure 1:
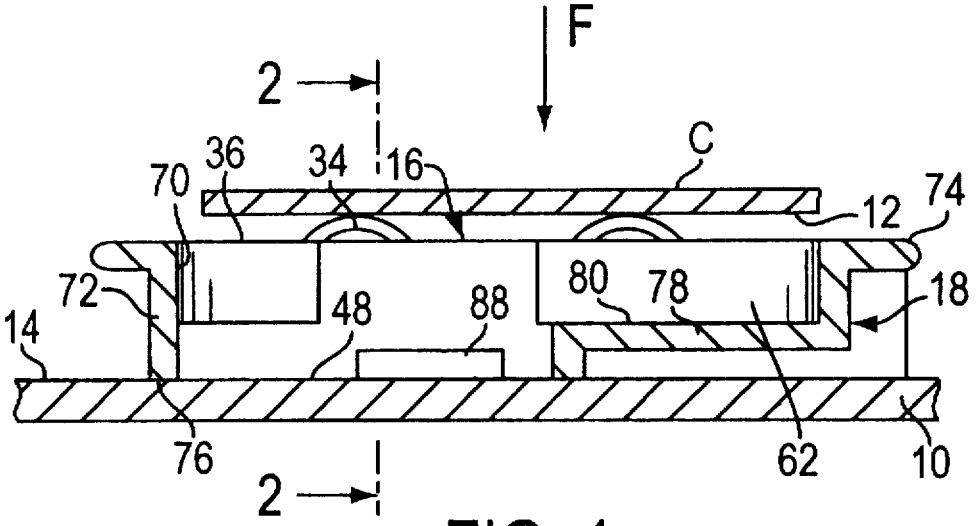
FIG. 1 is a partial sectional view taken on line 1—1 of FIG. 2, which illustrates a connector of the present invention, the connector being shown mounted on a circuit board in association with a protective casing.
Figure 3:
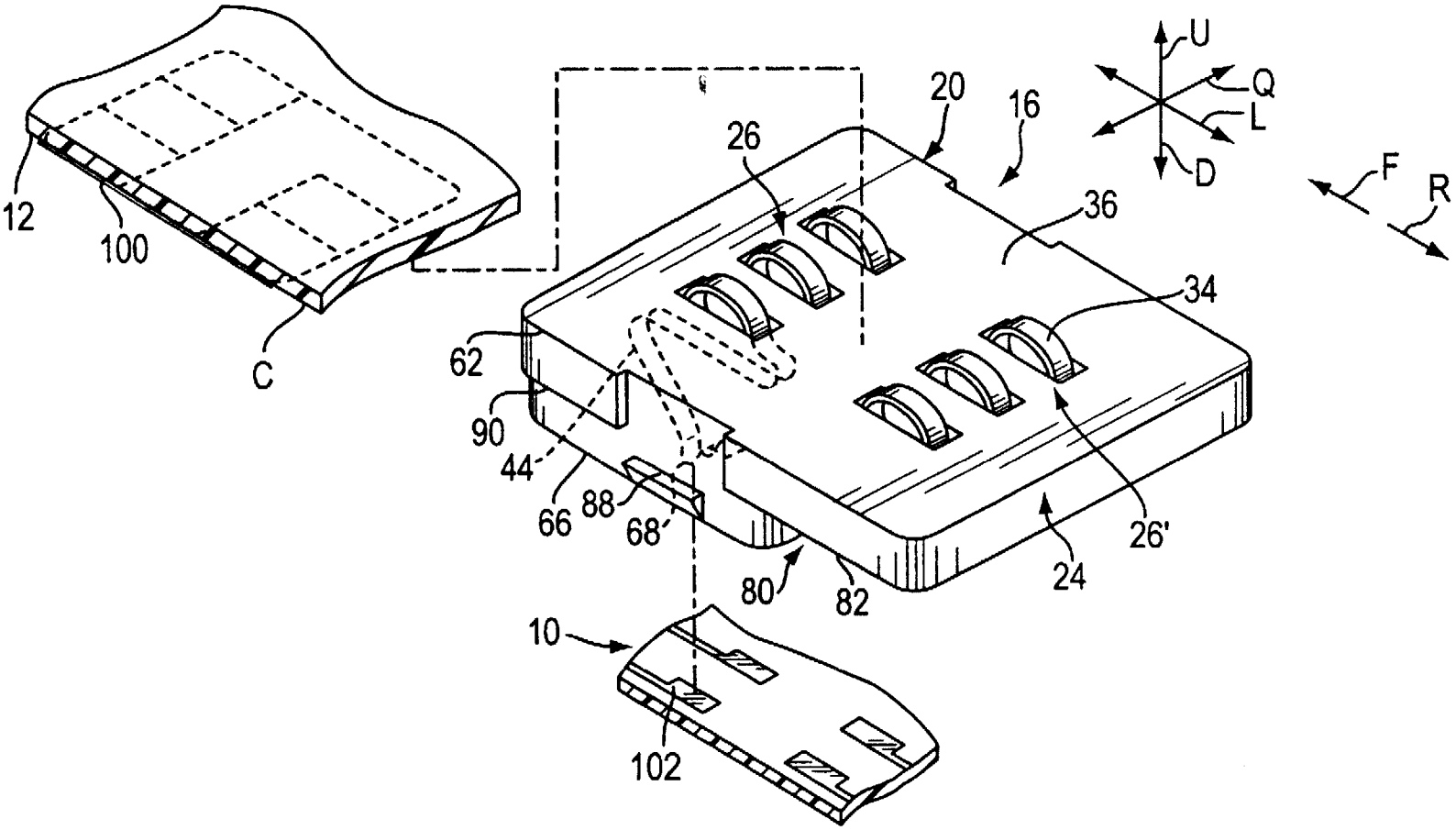
FIG. 3 is an isometric view of the connector without its protective casing, and also showing a portion of a card and a portion of a circuit board.

FIG. 1 shows a combination of a smart card C whose contact pads are to be connected to an electronic circuit of a device, usually a read/write device, which includes a printed circuit board 10. As shown in FIG. 3, the card has a lower face 12 that carries contact pads 100 that are connected to an integrated circuit of the card. The circuit board 10 has electrically conductive tracts or traces 102 that are connected to circuitry such as integrated circuits. The contact pads of the card are connected to the traces of the circuit board by an electrical connector 16. As shown in FIG. 1, the connector is mounted in a protective casing 18, and preferably an electrically conductive one which can provide shielding from electromagnetic energy. As shown in FIG. 3, the connector includes an insulative body 20 and two sets of electrical contacts 26, 26' mounted on the body. Each set of contacts is shown as including three contacts spaced in a lateral direction Q, with the two sets of contacts spaced in a longitudinal direction L. These two directions Q, L extend horizontally, and perpendicular to upward and downward directions U, D. The first set of contacts 26 are spaced in the forward direction F from the second set of contacts 26' which lie rearward R thereof.

Figure 8:
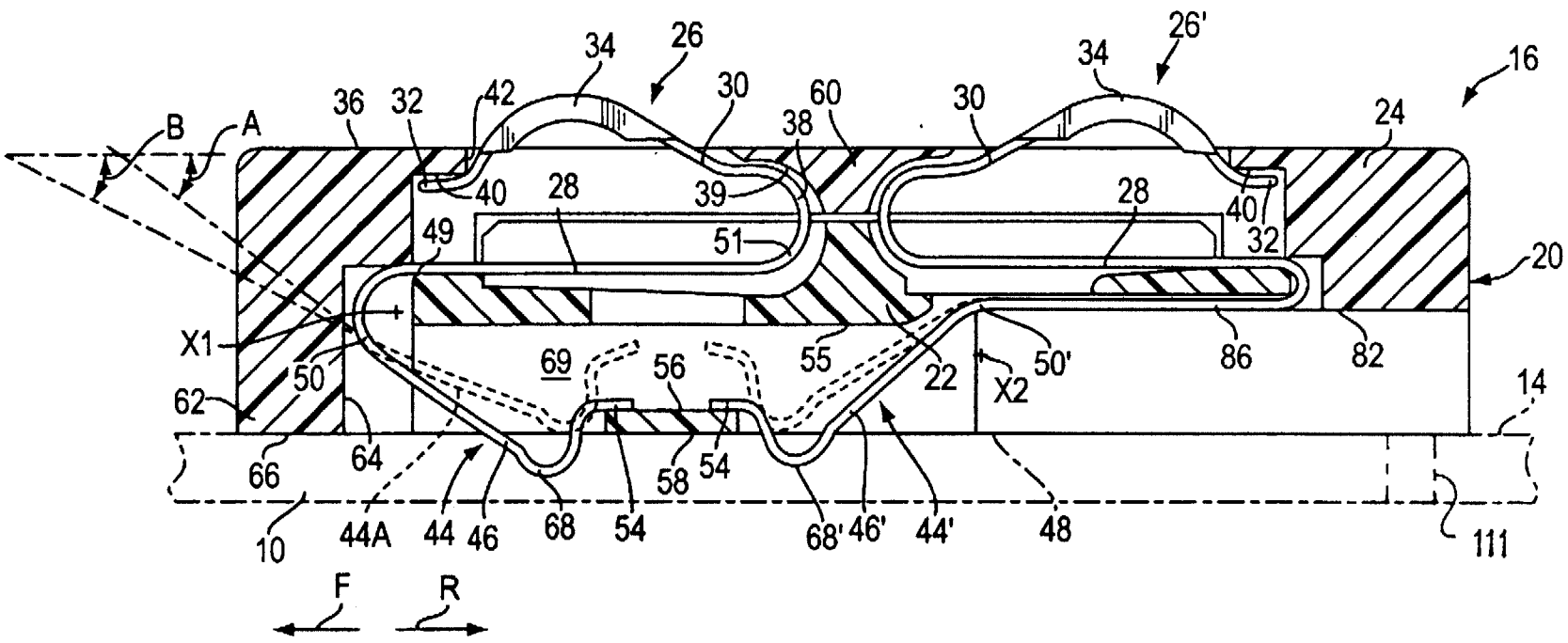
FIG. 8 is a sectional view on a large scale, taken on line 8—8 of FIG. 6.

As shown in FIG. 8, the body 20 of the illustrated connector 16, has a lower or inner part 22 surrounded by a separately molded upper or outer part 24. The contacts are mounted on and positioned by the body parts. Each contact has a design such as shown, for example, in document WO-A-95/18421. Each contact is in the form of a strip of conducting material, usually produced by cutting it out from sheet metal, folding, and bending the contact. Each contact includes an intermediate fixing portion 28 which is trapped at 49 between the upper and lower housing parts 22, 24, but with the fixing part being slightly pivotable and shiftable. Each contact also includes a card-engaging portion 30 which has a card-engaging part 34 that projects above the upper face 36 of the connector body. The card-engaging part 34 is curved with a convex surface facing upwardly. Each contact also includes a tail 44 (or 44') which extends largely downwardly and in a particular longitudinal direction (R) for the forward contacts 26, with a trace-engaging part 68 which can engage a trace on the upper face 14 of the circuit board 10.

The card-engaging portion 30 includes an upper elbow 38 that connects it to the fixing portion 28. The elbow is resiliently deflectable due to the inherence resilience of the contact material. The elbow urges the contact engaging part 34 upwardly and provides significant contact force to press the contact against the card. Up and down movement of the card-engaging part is due to flexing and pivoting of the card-engaging portion, with much of the pivoting occurring near the upper elbow 38. The initial position (no card present) of the card-engaging portion 30 is determined in large part by engagement of its free end 32 with an upper stop 40 formed on the connector body. The abutment surface or upper stop 40 forms a longitudinal end of a corresponding window 42 in the upper housing part 24. The top of the upper elbow 38 abuts a surface 39 of the connector body to also locate the card-engaging portion 30.

The tail 44 of the front contact includes a lower elbow 50 which connects the fixing portion 28 of the contact to an elongated tail limb 46. The tail limb extends to the trace-engaging part 68. A contact lower free end 54 extends beyond the trace-engaging part and is biased downwardly against a lower stop 58. The tail has been resiliently deflected to its initial position, shown in solid lines in FIG. 8, so the free end 54 presses down firmly against the upper surface 56 of the lower stop 58. The lower elbow 50 facilitates up and down movement of the rest of the tail, this occurring largely by bending at the lower elbow, although there is additional bending at the tail limb 46. The tail lies within a recess or cavity 69 that extends upwardly into the bottom of the housing. When the contact has moved down against the circuit board 10, the tail is deflected to the position shown in phantom lines at 44A. Most of the tail deflection occurs by pivoting about an axis X1 that lies at and within, the lower elbow 50.

It is noted that the lower stop 58 is in the form of a cross piece that extends laterally across the cavity 69 in the bottom of the connector body. The upper housing part 20 includes an upper wall 60 that is perforated with windows 42. The upper housing part has largely vertically-extending walls forming a peripheral skirt 62 of substantially rectangular contour that surrounds three sides of the lower housing part. The upper wall 60 and skirt 62 form a recess 64 in which the lower housing part 22 is received and fixed. Such fixing can be achieved by a variety of means including catches. The plane lower face 66 of the upper body part 24 is coplanar with the lower face 48 of the lower body part 22. As a result, both body parts may be directly supported by the circuit board.

When the connector 16 is moved down against the upper face 14 of the circuit board, the curved trace engaging parts 68, 68' of the contact tails engage the circuit board traces on the board upper face 14. This causes upward deflection of the tails to the positions shown in phantom lines in FIG. 8. In the installed position of the connector, the trace-engaging parts 68, 68' lie within the cavity 69 of the connector and are protected by the peripheral walls 62 of the body upper part 24.

Applicant prefers to mount the connector, as shown in FIG. 1, so it lies within a shielding casing 18 which has a recess 70 with a peripheral wall 72. In the mounted position, the casing completely horizontally surrounds the connector body. The upper face 74 of the casing is open to allow the downward insertion of the connector into the casing. The upper face 74 of the casing is substantially coplanar with the upper face 36 of the connector and allows the upward projection of the card-engaging parts 34 of the contacts. A lower face of the casing is also open, to allow the passage of the trace-engaging parts of the contacts. The casing illustrated, has an intermediate horizontal panel 78 which constitutes a bearing wall 80 that supports a raised wall 82 of the connector body. The casing 18 is preferably formed of electrically conductive material, to provide shielding against electromagnetic energy.

Figure 6:
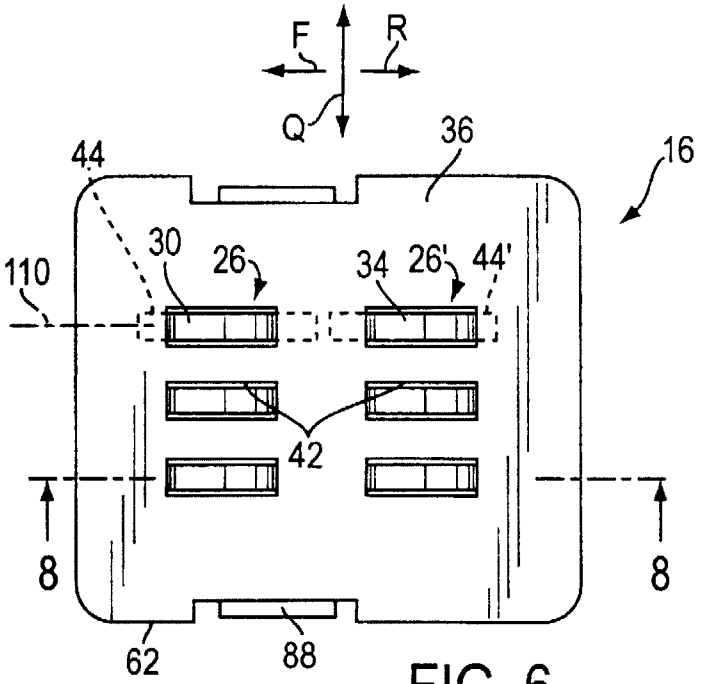
FIG. 6 is a top view of the connector of FIG. 4.
Figure 7:
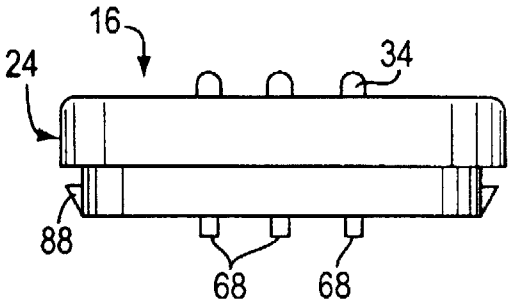
FIG. 7 is a left side elevation view of the connector of FIG. 4.
Figure 4:
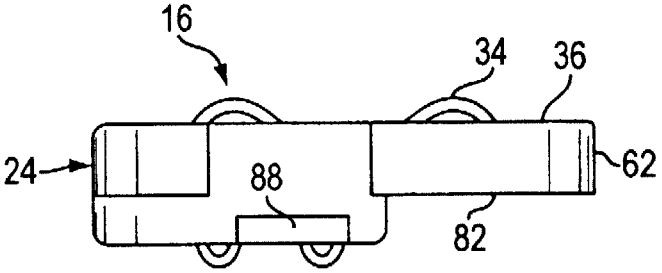
FIG. 4 is a side elevation view of the connector of FIG. 3.
Figure 5:
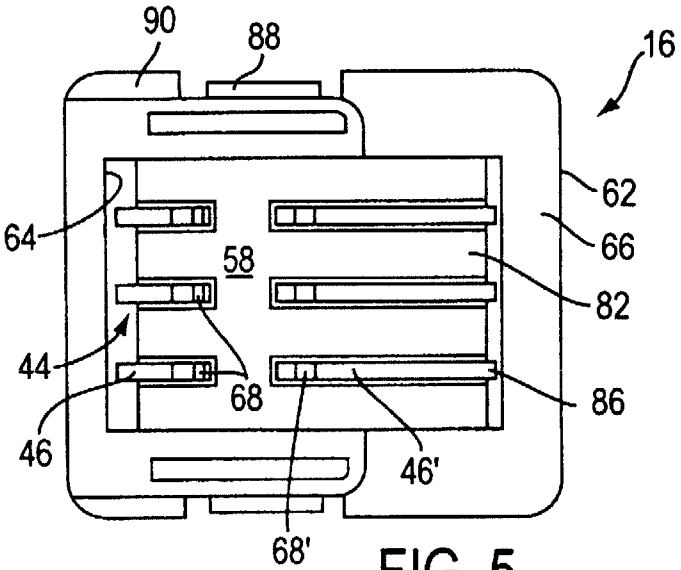
FIG. 5 is a bottom view of the connector of FIG. 4.

FIG. 8 shows that the two sets of contacts 26, 26' have tails 44, 44' of different constructions. For the forward contacts 26, the trace-engaging parts 68 lie substantially below the card-engaging parts 34. The contacts are not laterally bent, and FIG. 6 shows the centerline 110 of the contact is positioned so the card-engaging portion 30 of each contact lies in substantially the same plane as the tail 44 of the contact. FIG. 8 shows that the rear set of contacts 66 have tails 44' which are differently constructed. The second contacts 26' have second tail limbs 86 that extend substantially horizontally and parallel to the fixing portion 28 and that connect at a bend 50 of about 35° to a first tail end 46'. This construction results in the trace-engaging part 68' of each rear contact lying much closer to the trace-engaging part 68 of the front contacts. The close spacing of the trace-engaging parts 68, 68' results in the engaged location of the circuit board traces lying in a small area of the board, so additional area of the board is available for other connecting traces. The card-engaging parts 34 of the contact have their longitudinal spacing fixed by the spacing of the contact pads of the smart card.

Figure 2:
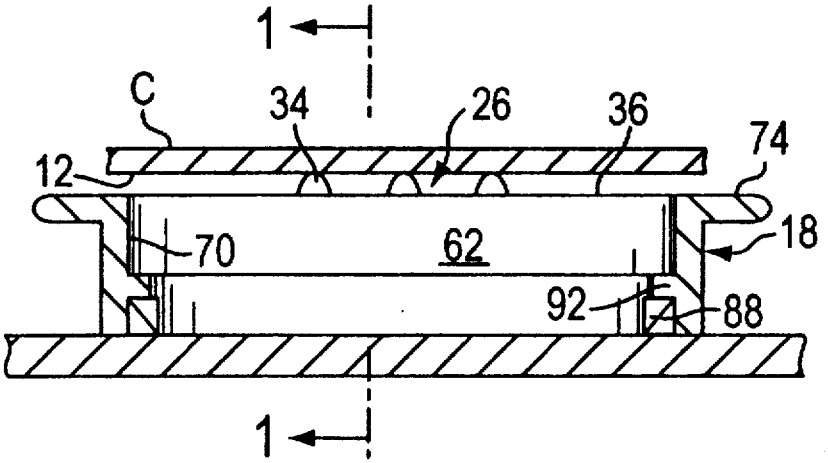
FIG. 2 is a partial sectional view taken on line 2—2 of FIG. 1.

The casing 18 of FIG. 1 is fixed to the circuit board, as by posts 111 that project into drilled holes in the board. As shown in FIG. 2, the connector has catches 88 at its laterally opposite sides, which move under shoulders 92 of the casing when the connector is pushed down into the casing, to thereby fix the connector in place on the board. Of course, the connector can itself be provided with means, such as posts, to fix it to the circuit board.

FIG. 8 shows that when the connector is moved down against the circuit board, the trace-engaging part 68 of the forward contacts, moves upward and rearward, the rearward motion causing sliding contact with the traces. Moderate sliding contact is desirable to assure low resistance contact. This is achieved by having the tail limb 46 extend at a moderate angle A from the horizontal, such as 35°. After the connector is installed, the tail limb 46 extends at a smaller angle B from the horizontal, such as 25°. If the initial angle A were much larger, such as more than 60°, then there is a possibility that frictional engagement of the tail with the circuit board trace would cause collapse of the tail instead of its smooth sliding. Also, such a large angle of more than 60° would result in large horizontal movement of the trace-engaging part. Thus, applicant prefers that the initial angle A be less than 60°.

While terms such as "upper", "lower", etc. have been used herein to describe the invention as it is illustrated, it should be understood that the invention can be used in any orientation with respect to the Earth.

Thus, the invention provides an electrical connector for connecting contact pads of a smart card to traces on a circuit board, wherein the connector is constructed to enable easy rapid installation. The connector has a plurality of contacts mounted on a connector body, each contact having an upper card-engaging portion for engaging a smart card, a lower tail for engaging a trace on the circuit board, and a fixing portion that is mounted on the connector body. The tail includes a lower elbow connecting the fixing portion to a largely straight elongated tail limb that extends at an angle of less than 60° to the horizontal, and that carries a trace-engaging portion at its lower end. When the connector is lowered onto the circuit board, the trace-engaging portion bears against the trace and deflects upwardly while continuing to press downwardly against the trace. A casing can be mounted on the circuit board and form an area into which the connector can be lowered and to which the connector can be latched, so that installation of the connector can be accomplished very easily.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A combination of a smart card that has contact pads, and a read/write device that includes a circuit board with an upper face and conductive traces thereon and that also includes a connector for connecting said card contact pads to said traces, wherein:

said connector includes an insulative body having upper and lower faces and upper and lower contact-engaging stops (40, 58) lying adjacent to said faces, said connector also includes a first set of contacts mounted on said body, with each of said contacts having a card-engaging portion with a card-engaging part that projects above said body upper face, with each contact having a tail with a trace-engaging part that lies at said lower face and engages one of said traces, and with each contact having a fixing portion that lies between said card engaging portion and said tail and that is substantially fixed to said body;

each of said contacts being formed of a strip of sheet metal which has a length in a predetermined longitudinal horizontal direction that is a plurality of times its length in a perpendicular lateral horizontal direction as seen in a plan view;

the card engaging portion of each contact has a free forward end (32) biased up against said upper stop and has a rear end that forms an upper elbow (38) comprising a largely 180° upper loop that merges with said fixing portion (28), with said fixing portion extending primarily forwardly from said upper elbow along most of the longitudinal length of said contact, with said tail having a forward-upper end forming a lower elbow (50) comprising a lower loop of more than 90° and with said tail having a tail limb (46) extending at a downward incline from said lower elbow to said trace-engaging part, and with said tail having a free rear end (54) biased down against said lower stop;

said upper elbow (38), the opposite sides of said upper loop are free to deflect closer together by bending along the largely 180° of said upper loop;

at said lower elbow (50) the opposite sides of said lower loop are free to deflect closer together by bending along said more than 90° of said lower loop, to raise said tail limb (48).

2. An electrical card connector for connecting contact pads of a smart card to a circuit board of a device, where the circuit board has an upper face with conductive traces thereon, wherein the connector has an insulative body with an upwardly-facing face for lying closely under the card and with a lower bearing face for lying on the upwardly-facing face of the circuit board, and has a plurality of sheet metal contacts mounted on the body, each contact having a card-engaging portion that projects above the body upper face, an intermediate fixing portion mounted on the body, and a contact tail for engaging a circuit board trace, wherein:

each of said contact tails has a trace-engaging part, and each of said tails is resiliently deflectable and is downwardly biased toward a position wherein said trace-engaging part lies below said lower bearing face of the connector body, but with said connector body having a cavity that opens into said lower bearing face, and with said trace-engaging part being movable up into said cavity and down below said cavity;

each of said contact tails includes a substantially straight tail limb (46) extending at an acute angle of less than 60° with respect to the plane of said body lower bearing face (66), and said tail has a lower elbow (50) that is curved by more than 90° and that connects said fixing portion (28) to said tail limb, said elbow being resiliently bendable to allow said tail limb and said trace-engaging part (68) to pivot about an axis (X1) lying substantially at said elbow in movement of said trace-engaging part below said cavity primarily by bending of said elbow.

3. An electrical card connector for connecting contact pads of a smart card to a circuit board of a device, where the circuit board has an upwardly-facing face with conductive traces thereon, wherein the connector has an insulative body with an upper face for lying closely under the card and with a lower bearing face for lying on the upper face of the circuit board, and has a plurality of sheet metal contacts mounted on the body, each contact having a card-engaging portion that projects above the body upwardly-facing face, an intermediate fixing portion mounted on the body, and a contact tail for engaging a circuit board trace, wherein:

each of said contact tails has a trace-engaging part, and each of said tails is resiliently deflectable and is downwardly biased toward a position wherein said trace-engaging part lies below said lower bearing face of the connector body, but with said connector body having a cavity that opens into said lower bearing face, and with said trace-engaging part being movable up into said cavity and down below said cavity;

said plurality of contacts includes first and second sets of contacts (26, 26'), with all of said plurality of contacts being elongated in forward and rearward longitudinal directions as seen in a plan view, with the contacts of each set being laterally spaced apart, and with said contacts of said first set lying forward of said contacts of said second set;

said contact tails having elongated longitudinally-extending limbs, with the limbs (46) of said contacts of said first set extending rearwardly and the limbs (46') of said contacts of said second set extending forwardly and positioning said trace-engaging parts (68') of said second contacts so they lie closer, in a longitudinal direction, to the trace-engaging parts (68) of said first contacts, then do the card-engaging parts (26, 26') of said first and second contacts.

4. A combination of a circuit board and an electrical card connector mounted on said circuit board, for connecting contact pads of a smart card to the circuit board of a device, where the circuit board has an upper face with conductive traces thereon, wherein the connector has an insulative body with an upwardly-facing face for lying closely under the card and with a lower bearing face lying on an upper face of the circuit board, and wherein the connector has a plurality of sheet metal contacts mounted on the body, each contact having a card-engaging portion that projects above the body upwardly-facing face, an intermediate fixing portion mounted on the body, and a contact tail for engaging a circuit board trace, wherein:

each of said contact tails has a trace-engaging part, and each of said tails is resiliently deflectable and is downwardly biased toward a position wherein said trace-engaging part lies below said lower bearing face of the connector body, but with said connector body having a cavity that opens into said lower bearing face, and with said trace-engaging part being movable up into said cavity and down below said cavity;

a protective metal casing (18) mounted on said circuit board, said casing horizontally completely surrounding said connector body so said connector can be installed in said casing when said casing lies on said circuit board, only by downwardly movement of said connector into said casing, with said casing having an open top lying no higher than the level of the top of said connector body, for the passage of the card-engaging parts of said contacts, and with said casing having an open bottom for the passage of said trace-engaging parts of said contact tails.

* * * * *